United States Patent [19]

Mochizuki et al.

[11] Patent Number: 4,806,388

[45] Date of Patent: Feb. 21, 1989

[54] METHOD AND APPARATUS FOR COATING METAL PART WITH SYNTHETIC RESIN

[75] Inventors: Hiroyuki Mochizuki, Aichi; Nobuo Kobayashi; Shigenori Tamaki, both of Toyota; Takahiro Iwase, Anjyo; Naofumi Masuda; Yoshio Taguchi, both of Nagoya, all of Japan

[73] Assignee: Toyota Jidosha Kabushiki Kaisha, Toyota, Japan

[21] Appl. No.: 886,392

[22] Filed: Jul. 17, 1986

[51] Int. Cl.[4] ..... B05D 3/14

[52] U.S. Cl. ..... 427/46; 427/185; 427/195; 118/429; 118/620; 118/DIG. 5

[58] Field of Search ..... 427/46, 185, 195; 118/DIG. 5, 429, 620

[56] References Cited

U.S. PATENT DOCUMENTS

| | | | |
|---|---|---|---|
| 2,974,059 | 3/1961 | Gemmer | 427/185 |
| 2,974,060 | 3/1961 | Dettling | 427/185 |
| 3,063,860 | 11/1962 | Gemmer | 427/195 X |
| 3,090,696 | 5/1963 | Gemmer | 427/185 |
| 3,097,958 | 7/1963 | Morris | 118/DIG. 5 |
| 3,161,483 | 12/1964 | Morris | 34/57 |
| 3,183,113 | 5/1965 | Gemmer | 427/185 |
| 3,197,328 | 7/1965 | Jung et al. | 118/DIG. 5 |
| 3,227,636 | 1/1966 | De Hart | 427/185 X |
| 3,250,643 | 5/1966 | Sergent | 118/DIG. 5 |
| 3,261,707 | 7/1966 | Korski et al. | 118/DIG. 5 |
| 3,282,249 | 11/1966 | Ramsay | 118/DIG. 5 |
| 3,383,233 | 5/1968 | Curcio | 427/185 X |
| 3,419,409 | 12/1968 | Dettling | 427/185 |
| 3,431,887 | 3/1969 | Pettigrew et al. | 118/DIG. 5 |
| 3,514,308 | 5/1970 | Scott et al. | 427/185 |
| 3,925,570 | 12/1975 | Reinke et al. | 427/46 |
| 3,959,525 | 5/1976 | Sentementes et al. | 427/185 |
| 3,985,097 | 10/1976 | Sitton | 427/185 X |
| 4,466,989 | 8/1984 | Haller et al. | 427/185 |
| 4,693,813 | 9/1987 | Takeshita et al. | 409/244 |

FOREIGN PATENT DOCUMENTS

| | | | |
|---|---|---|---|
| 682664 | 3/1964 | Canada | 427/185 |
| 238185 | 11/1985 | Japan . | |

OTHER PUBLICATIONS

B. Wiedemann, SAE Technical Paper Series (Development of Volkswagen's Supercharger G-Lader), Feb. 24–28, 1986.

Stott, Louis L., "Fluidized Bed Method of Coating", *Organic Finishing* (Jun. 1956) pp. 16–17.

"Powder Coating", *Products Finishing* (Oct. 1970) pp. 70–77.

PTO, English Translation of 60-238185, Dec. 1987.

*Primary Examiner*—Shrive Beck

*Assistant Examiner*—Alain Bashore

*Attorney, Agent, or Firm*—Oblon, Fisher, Spivak, McClelland & Maier

[57] ABSTRACT

A method and apparatus for applying a synthetic resin layer to an outer surface of a metal part while the metal part is placed within a powdered mass of a thermally fusible synthetic resin. The metal part within the powdered mass is induction-heated to a temperature higher than a melting point and lower than a thermal decomposition point of the synthetic resin, in order to melt a portion of the powdered mass surrounding the heated metal part, and thereby permit the molten portion of the powdered mass to be deposited as the synthetic resin layer on the outer surface of the heated metal part. To facilitate the placement of the metal part in the powdered mass, air may be blown into the powdered mass to keep the mass in a fluid state.

13 Claims, No Drawings

METHOD AND APPARATUS FOR COATING METAL PART WITH SYNTHETIC RESIN

BACKGROUND OF THE INVENTION

1. Field of the Art

The present invention relates in general to a method and apparatus for producing a resin-coated metal part, and more particularly to a method and apparatus adapted to apply a resin layer to an outer surface of a metallic core member to produce a resin-coated metal part, while the core member heated to an elevated temperature is placed within a powdered mass of a thermally fusible resin.

2. Related Art Statement

Various resin-coated metal parts are known. For example, a metallic core member of a rotor for a rotary fluid machine of a Roots type such as a supercharger for a motor vehicle is coated at its outer peripheral surface with a thermally fusible synthetic resin. For applying such a synthetic resin coating (hereinafter called "resin layer") to the outer surface of a metallic core member, various methods are known. For instance, the metallic core member is first heated and then embedded within a powdered mass of a synthetic resin accommodated in a suitable container, so that a portion of the powdered mass surrounding the outer surface of the core member is melted and deposited on the outer surface of the core member. Thus, the outer surface of the metallic core member is coated with a resin layer. In one form of the above coating method, a gaseous fluid is blown into the powdered mass through a gas-permeable bottom wall of the container, to maintain the powdered mass in a fluid state and thereby enable the heated metallic core member to be easily immersed in the powdered mass. The above method (hereinafter referred to as the "powdered coating method") wherein a synthetic resin powdered is applied to a heated metallic core member, permits formation of a resin layer of a relatively large thickness in one coating cycle, with comparatively less costly equipment, and is therefore widely utilized in the industry to produce resin-coated parts.

The powdered coating method is effectively practiced where the synthetic resin used is polyethylene, nylon 11, 12 or other material which has a relatively low melting point and a relatively high thermal decomposition point. However, where there is a comparatively small difference between the melting and thermal decomposition points of a synthetic resin, for example, where a resin containing fluoroethylene is used, the powdered coating method is not satisfactory in terms of the thickness of a resin layer that can be obtained in one coating cycle (by one placement of a heated metallic core member into a powdered mass). In the powdered coating method, the fusion of a synthetic resin and consequent deposition thereof to the surface of the core member occurs after the heated metallic core member has been embedded or immersed in the powdered mass, and before the core member has been cooled below its melting point. Therefore, the smaller the difference between the melting and thermal decomposition points of the synthetic resin, the shorter the period during which the fusion of the synthetic resin occurs. Accordingly, where the above-indicated difference of the resin material is small, the thickness of the resin layer to be formed on the outer surface of the core member in one coating cycle is not sufficient. To obtain a sufficient thickness of the resin layer, the coating cycle must be repeated several times. On the other hand, heating of the metallic core member must be accomplished outside the powdered mass in which the heated core member is coated with a resin material of the powdered mass. Namely, these two steps of the coating cycle must be conducted at different locations. This requirement further complicates the powdered coating process, and requires a relatively long time to complete the process.

SUMMARY OF THE INVENTION

It is accordingly an object of the present invention to provide a method of applying a synthetic resin layer to an outer surface of a metal part, which permits the resin layer of a sufficient thickness to be formed in one coating cycle, with a relatively simple coating apparatus.

Another object of the invention is the provision of an apparatus suitable for practicing the method of the invention.

According to the present invention, there is provided a method of applying a synthetic resin layer to an outer surface of a metal part, comprising: (a) placing the metal part within a powdered mass of a thermally fusible synthetic resin; (b) induction-heating the metal part within the powdered mass to a temperature beween a melting point and a thermal decomposition point of the synthetic resin, thereby melting a portion of the powdered mass surrounding the outer surface of the heated metal part, and permitting the molten portion of the powdered mass to be deposited on the outer surface of the heated metal part, as the synthetic resin layer having a predetermined thickness; and (c) removing the metal part coated with the synthetic resin layer, out of the powdered mass.

In the method of the invention described above, the metal part can be heated to a suitable elevated temperature at which the synthetic resin is fused but not decomposed. Further, the elevated temperature of the metal part may be maintained by adjusting an induction current applied to effect the induction heating. According to the present method, the deposition of the resin layer onto the outer surface of the metal part takes place concurrently with the heating of the metal part. The desired thickness of the resin layer may be obtained in one coating cycle, namely, by a single action of placing the metal part in the mass of the synthetic resin powdered, even where the synthetic resin has a comparatively small difference between its melting and thermal decomposition points.

Further, a variation in the thickness of the synthetic resin layer may be held to a minimum, since the temperature of the metal part placed within the powdered mass may be easily controlled. Furthermore, as the melting of the powdered mass always progresses starting from its portion in contact with the outer surface of the heated metal part, voids are not left in the synthetic resin layer to be formed on the metal part. This is in contrast to the known method wherein a metal part is repeatedly heated in a furnace until a resin layer covering the metal part is given an intended thickness. In this case, the resin layer in a process of its formation on the metal part is heated from its outer surface in each heating cycle in the furnace, whereby voids are likely to be left in the resin layer finally formed on the metal part. According to the method of this invention, however, such voids are minimized because the metal part itself serves as a heat source for melting the portion of the powdered mass adjacent the outer surface of the metal part.

According to one advantageous feature of the present invention, air is blown into the powdered mass through a bottom of a container accommodating the powdered mass, whereby the powdered mass is kept in a fluid state. In this case, the metal part is immersed into the powdered mass in the fluid state, that is, the metal part may be easily embedded within the powdered mass by moving the metal part into the mass of the synthetic resin powdered which is fluidized by the air blown into the powdered mass. The step of blowing air into the powdered mass may be continued while the metal part is being induction-heated, or may be stopped before the induction heating of the metal part is started. For better fluidity of the synthetic resin powdered in the container, it is preferable to oscillate the container while the metal part is immersed into the fluid powdered mass.

According to another feature of the present invention, the power mass is accommodated in a container made of a dielectric material, and the metal part is induction-heated by applying a current to an induction heating coil which is disposed so as to surround the container.

According to a further feature of the invention, the metal part is subjected to preliminary heating to a temperature higher than the melting point of the synthetic resin, before the metal part is placed within the powdered mass. In this case, the metal part is heated primarily in the preliminary heating step, and the induction heating of the metal part within the powdered mass is used to maintain the metal part at a temperature above the melting point of the synthetic resin. Since the preliminary heating is effected outside the powdered mass, a loss of thermal energy due to absorption of heat by the powdered mass is reduced, whereby the overall heating efficiency is improved. Further, the preliminary heating minimizes the development of voids at the interface between the outer surface of the metal part and the powdered mass, which voids may possibly be produced due to the presence of air in the powdered mass, where the metal part is heated within the powdered mass from the ambient temperature to a temperature above the melting point of the synthetic resin. Consequently, the preliminary heating of the metal part minimizes undesirable voids left in the synthetic resin layer formed on the metal part, and accordingly increases the adherence of the synthetic resin layer to the outer surface of the metal part. The preliminary heating discussed above may also be effected by induction heating.

According to a still further feature of the invention, the metal part coated with the resin layer removed out of the powdered mass is subjected to supplemental post heating to a temperature higher than the melting point of the synthetic resin, whereby incompletely melted particles of the synthetic resin which are deposited on the outer surface of the metal part are completely melted and deposited, eventually forming part of the synthetic resin layer. Hence, the synthetic resin material is effectively utilized, with a minimum waste due to removal of incompletely melted resin particles from the surface of the synthetic resin layer formed on the metal part. The supplemental post heating of the metal part may also be effected by induction heating.

The method of the present invention discussed above may be applied to the production of a resin-coated rotor for a rotary fluid machine of a Roots type such as a supercharger for an automotive vehicle. In this case, the synthetic resin may consists of a copolymer of tetrafluoroethylene and ethylene.

According to another aspect of the present invention, there is also provided an apparatus suitably used to practice the method of the invention. The apparatus comprises: (a) a container for accommodating a powdered mass of a thermally fusible synthetic resin, having a bottom wall of a gas-permeable structure; (b) blower means for blowing a gaseous fluid into the powdered mass through the bottom wall of the container, thereby keeping the powdered mass in a fluid state; (c) a handling device operable for immersing the metal part into the powdered mass and removing the metal part out of the powdered mass; and (d) an induction heating coil energized to heat the metal part placed within the powdered mass in the fluid state.

In one form of the apparatus of the invention, the container has a side wall made of a dielectric material, and the induction heating coil is disposed so as to surround the side wall of the container.

In another form of the apparatus, the induction heating coil is disposed within the container, so as to surround the metal part immersed within the powdered mass.

In a further form of the apparatus, another heating coil is provided for induction-heating the metal part while it is located outside of the powdered mass.

The apparatus of the invention described above may be suitably used for applying a synthetic resin coating to a core member of a rotor for a rotary fluid machine of a Roots type such as a supercharger for an automotive vehicle, which core member has at least one bore formed in an axial direction of the rotor. In this case, the handling device includes closure means for closing opposite open ends of the axial bore, and holder means for holding the core member with the open ends of the axial bore closed by the closure means.

BRIEF DESCRIPTION OF THE DRAWINGS

The foregoing and other objects, features and advantages of the present invention will be better understood by reading the following detailed description of preferred embodiments of the invention, when considered in connection with the accompanying drawings, in which.

DESCRIPTION OF THE PREFERRED EMBODIMENTS

Figure 1:
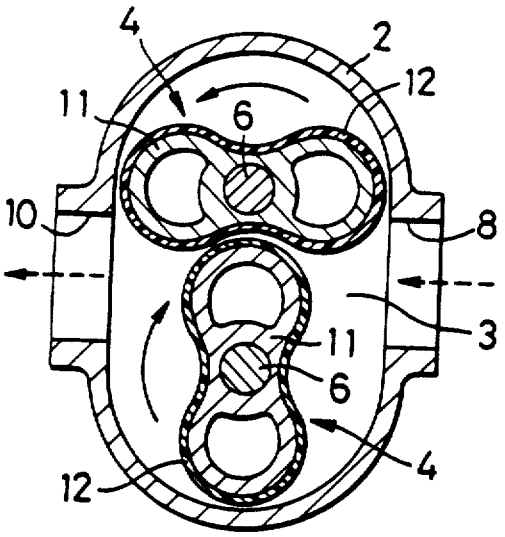
FIG. 1 is an elevational view in cross section of an example of a rotary fluid machine of a Roots type in the form of a supercharger using lobe-type rotors, to which the present invention is applicable.

Referring first to FIG. 1, there is illustrated a rotary lobe-type fluid machine of a Roots type in the form of a supercharger used on an engine of an automotive vehicle to increase volumetric efficiency by forcing a greater quantity of air into the cylinders. The supercharger has a housing which consists of a hollow housing body 2, and a pair of end plates (not shown) which close opposite open ends of the hollow housing body 2, and cooperate with the hollow housing body 2 to define an air-tight pump chamber 3. The housing rotatably supports a pair of parallel support shafts 6, 6 which support a corresponding pair of lobe-type rotors 4, 4 accommodated in the pump chamber 3. The two lobe-type rotors 4, 4 are coupled to each other by a pair of timing gears (not shown) fixed to one end of the corresponding support shafts 6, 6, so that the two rotors 4, 4 are rotated in opposite directions at the same angular velocity, whereby air is sucked into the pump chamber 3 through an inlet 8 formed in the housing body 2, and the compressed air is discharged from the pump chamber 3 through an outlet 10 also formed in the housing body 2.

Each lobe-type rotor 4, 4 consists of a metallic core member 11, and a resin layer 12 of a suitable thickness which covers an outer surface 26 of the core member 11. The resin layer 12, which is applied according to the preferred embodiments of the invention which will be illustrated, is provided to minimize gaps between the two rotors 4, 4, and between the rotors 4, 4 and the inner surface of the hosing body 2, and to thereby improve the volumetric efficiency of the supercharger.

Figure 2:
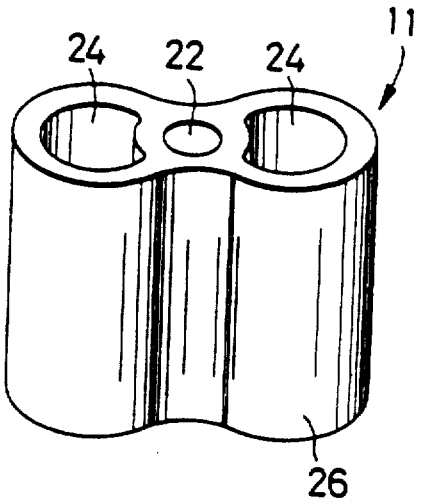
FIG. 2 is a perspective view of a metallic core member of one of the lobe-type rotors of the supercharger of FIG. 2.

As illustrated in enlargement in FIG. 2, the metallic core member 11 (hereinafter referred to as "workpiece" as appropriate) has a transverse cross sectional shape similar to the shape of a cocoon or peanut shell, and is made of an aluminum alloy, more precisely, an aluminum-silicon alloy having a silicon content as high as about 12% (according to Japanese Industrial Standards, JIS A 4047, for example). The core member 11 has a central axial bore 22 in which the support shaft 6 is press-fitted. The core member 11 further has two axial bores 24, 24 which are formed parallel to the central axial bore 22, so as to extend through opposite lobe portions of the core member 11 on diametrically opposite sides of the central bore 22. These additional bores 24 are provided for reducing the weight of the rotor 4. The bores 22 and 24 are all open on opposite end faces of the core member 11.

The resin layer 12 is formed of a powdered of thermally fusible synthetic resin, for example, AFLON (registered trademark) which is a copolymer of tetrafluoroethylene and ethylene.

The outer surface 26 of the workpiece or core member 11 to be covered by the resin layer 12 is preferably pre-treated before the resin layer 12 is applied thereto. The outer surface 26 may be pre-treated by degreasing and subsequent water rinsing. For increased adherence of the resin layer 12 to the outer surface 26, however, it is advisable that the pre-treatment comprises: preliminary washing and subsequent drying of the outer surface 26; bombarding particles of hard substances onto the dried outer surface 26 at a higher speed, so as to create a multiplicity of concavities in the surface 26; degreasing the surface 26 with an alkalescent degreasing agent; and water rinsing the surface 26 to remove the degreasing agent.

The bombardment of the hard substance particles may be accomplished by shot blasting, grit blasting, sand blasting, or any other suitable method, so as to apply the particles together with a compressed air, or by utilizing a centrifugal force. In particular, the shot blasting method is preferred. For example, steel balls of about 0.6 mm diameter are bombarded against the outer surface 26 of the core member 11, at about 60–80 m/sec., for about 60 seconds. In this case, the outer surface 26 may be given sufficient roughness, which may range from 40 to 70 μm Rz (Rz: average ten-point roughtness). With a bombarding operation to form multiple concavities in the outer surface 26, the total bonding area of the surface 26 with respect the resin layer 12 is increased, and the surface 26 is activated by means of a grinding action by the bombardment of the hard substances.

While the above-indicated degreasing agent may be removed solely by water rinsing (e.g., by a shower of hot water), it is preferred o apply a shower of water or hot water to the surface 26 while the surface 26 is brushed with a wire brush or other tools. The brushing is effective to mechanically remove barrs or nicks produced by a blast of the hard particles, or chips adhering to the treated surface 26. The brushing action, which may cause scratches on the surface 26, also contributes to further roughening the surface 26.

Figure 3:
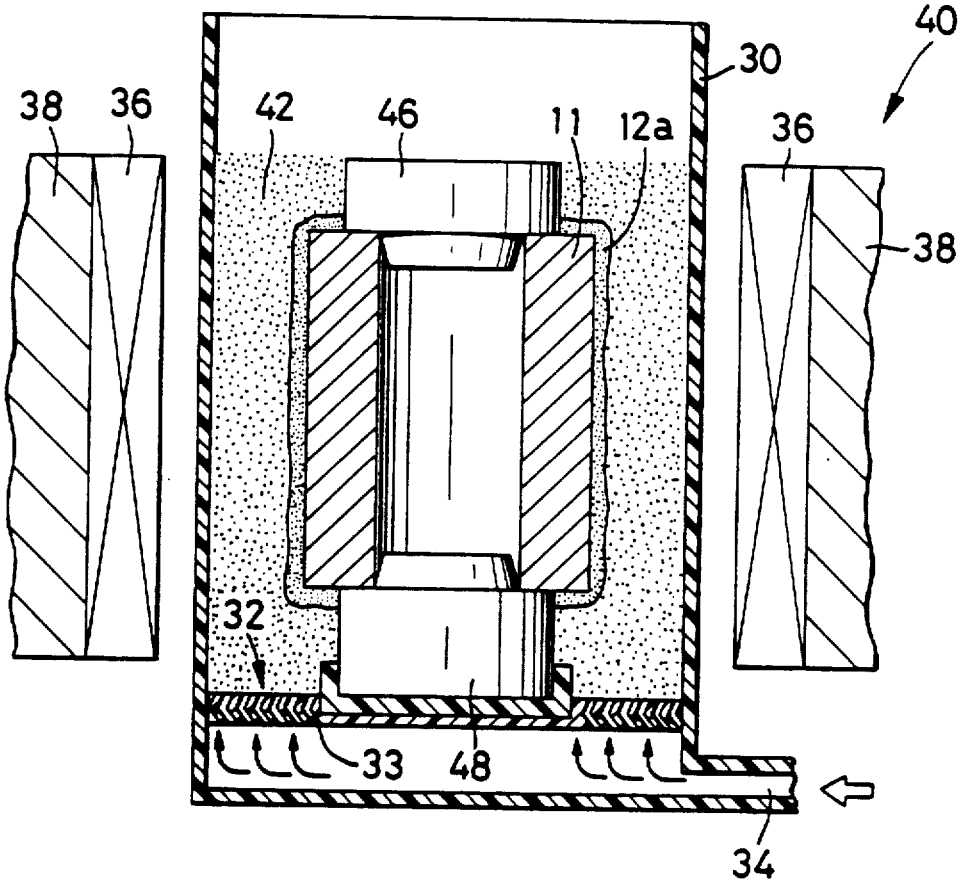
FIG. 3 is a schematic elevational view in cross section of one embodiment of an apparatus of the invention for applying a synthetic layer to an outer surface of the core member of FIG. 2.

After the workpiece 11 is finally dried, the resin layer 12 is applied to the pre-treated outer surface 26, by the apparatus schematically illustrated in FIG. 3.

In FIG. 3, reference numeral 30 designates a container made of a dielectric material such as plastics. The container 30 has a gas-permeable bottom wall 32 with a multiplicity of air blow holes 33 formed therein, and an air passage 34 which communicates with the interior of the container 30 through the air blow holes 33 in the bottom wall 32. Air introduced through the air passage 34 is blown through the air blow holes 33, as ascending currents of air within the container 30. An induction heating coil 36 is supported by a coil holder 38 so that the coil 36 is disposed so as to surround the side wall of the container 30. The heating coil 36 and the coil holder 38 constitute a major part of an induction heating device 40 of the apparatus.

To form the resin layer 12 on the outer surface 26 of the workpiece 11, the apparatus is operated in the following manner:

Initially, a powdered mass 42 of a thermally fusible synthetic resin such as the previously indicated copolymer (AFLON) of tetrafluoroethylene and ethylene is introduced into the container 30. Then, air is introduced into the container 30 through the air passage 34 and the air blow holes 33 in the bottom wall 32, whereby the powdered mass 42 is maintained in a fluid state as if the powdered mass 42 were a fluid. The workpiece 11 (i.e. core member) is introduced or immersed into the powdered mass 42 in the fluid state. Before the workpiece 11 is introduced in the powdered mass 42, the openings of the axial bores 22, 24 are closed by closure members 46, 48, to prevent the inner surfaces of the bore 22, 24 and the inner portions of the end faces of the workpiece 11 from being exposed to the powdered mass 42. The closure member 46 also serves as a holder member for holding the workpiece 11 within the powdered mass 42. The two members 46, 48 are made of a suitable dielectric material such as plastics.

After the metal workpiece 11 has been correctly installed within the powdered mass 42, an electric current of a predetermined frequency is applied to the induction heating coil 36, so as to produce an alternating field within the container 30, whereby eddy currents are induced in the metal workpiece 11, heating the workpiece 11, particularly its peripheral portion, to a predetermined temperature between a melting point of the synthetic resin of the powdered mass 42 and a thermal decomposition point of the resin. When the temperature of the workpiece 11 at its outer surface 26 has been elevated to the predetermined temperature, or to a point slightly below that temperature, the current to be applied to the coil 36 is regulated so as to maintain the temperature of the workpiece 11 at the predetermined temperature. It is noted that the container 30 and the closure members 46, 48 which are made of dielectric materials will not be induction-heated by the heating device 40.

When the temperature of the workpiece 11 has exceeded the melting point of the powdered mass 42, a portion of the powdered mass 42 adjacent to the outer surface 26 of the workpiece 11 begins to melt and be deposited on the outer surface 26, as a molten resin layer **12*a* (which will comprise the resin layer 12). The molten resin layer 12*a* will develop with its thickness increasing with the heating time period. The air blown into the powdered mass 42 and the power supply to the induction heating coil 36 are discontinued when the molten resin layer 12 has reached a predetermined thickness. While the workpiece 11 is gradually cooled after the deenergization of the coil 36, the fluidity of the molten resin layer 12*a* is more or less maintained, which contributes to smoothing the surface of the resin layer 12 which will be obtained after the molten layer 12*a* has been cooled. Cooling of the workpiece 11 may be achieved after the workpiece 11 has been taken out of the powdered mass 42**.

The method described above permits easy application of the resin layer 12 to the outer surface 26 of the metallic core member 11 (workpiece), in a comparatively short period of time, by maintaining the workpiece 11 within the powdered mass 42 at the predetermined elevated temperature and thereby causing the adjacent portion of the powdered mass 42 to be melted and deposited on the outer surface 26 of the workpiece 11. That is, the coating material is deposited onto the surface 26 while the workpiece 11 is being induction-heated. Consequently, the desired thickness of the molten resin layer **12*a* may be obtained with a single immersing action of the workpiece 11 into the powdered mass 42, without repeating a heating-and-cooling cycle of the workpiece 11, and therefore without repeating mounting and dismounting of the closure members 46, 48 on and from the workpiece 11, respectively. Further, the induction heating allows the workpiece 11** to be rapidly heated to the desired temperature, resulting in significant improvement in the operating efficiency.

In the conventional powdered coating process wherein a workpiece is immersed in a powdered mass of a coating material, the workpiece is first heated to a predetermined temperature outside the powdered mass, and the heated workpiece is then immersed into the powdered mass for deposition of the molten coating material onto the workpiece surface. In other words, the step of heating the workpiece, and the step of applying the coating material to the workpiece areeeffected at different times. As a result, it is impossible to maintain the workpiece at the predetermined constant temperature, while the coating material is applied to the workpiece. In other words, the deposition of the coating material can be achieved only while the temperature of the workpiece within the powdered mass is maintained above the melting point of the coating material. Due to a comparatively limited coating time period, the thickness of a molten eesin layer to be obtained by one immersing operation of the workpiece is accordingly limited, whereby the heating and immersing cycle must be repeated a suitable number of times necessary to obtain the desired thickness of the resin layer to be eventually formed on the workpiece. As previously indicated, closure or masking members for preventing the adhesion of the coating material to the inner surface of the workpiece must be mounted and dismounted each time the workpiece is heated. This requirement further increases the number of steps to be performed for applying the resin layer to each workpiece. If the closure members are heated when the workpiece is heated, the molten coating material unfavorably adheres to the heated closure members.

Thus, the conventional coating method requires a complicated process and a relatively long processing time period. Further, the resin layer to be obtained tends to have undesirable voids, since a partly formed resin layer on the workpiece is heated when the workpiece is heated in the repeated heating and coating cycles.

The coating method according to the illustrated embodiment of the invention does not suffer from the inconveniences encountered in the conventional method. It is noted that the closure members 46, 48 will not be induction-heated, and therefore there is no need to remove burrs or nicks of the synthetic resin material from the closure members 46, 48 after the resin layer 12 has been formed.

Figure 4:
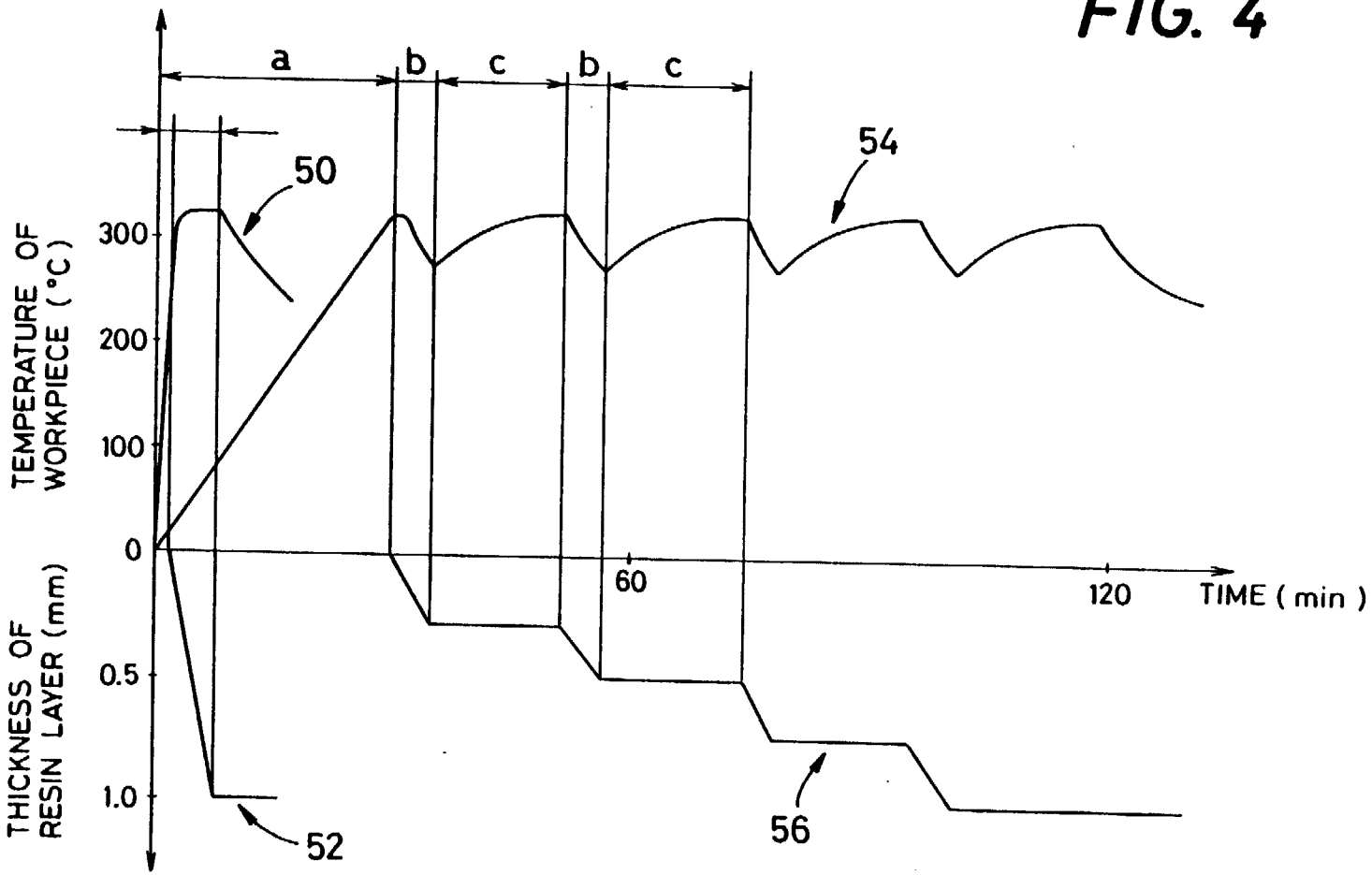
FIG. 4 is a graphical illustration showing a relation between the temperature of the core member and the thickness of the synthetic resin layer, in relation to time.

Referring next to FIG. 4, there are depicted the characteristics of the illustrated embodiment of the invention, wherein reference number 50 designates a temperature-time curve which indicates the temperature (ordinate) of the workpiece 11 varying with the time (abscissa). Reference number 52 designates a thickness-time curve which indicates the thickness of the molten resin layer **12*a* varying with the time. Reference numerals 54, 56 designates curves of the conventional powdered coating method, corresponding to the curves 50, 52 of the illustrated embodiment. In the figure, time span "a" indicates a step of heating the workpiece from the ambient temperature to the predetermined temperature according to the conventional method, and time span "b" indicates a step of applying a molten coating material to the workpiece. Time span "c" indicates a step of re-heating the workpiece to fluidize the coating material adhering to the workpiece, for smoothing the surface of the partly formed resin layer. As indicated in FIG. 4, the conventional method requires repeating the heating of the workpiece and the immersion of the workpiece into the powdered mass, in order to obtain the intended thickness of the resin layer (1.0 mm in this specific example). Hence, an extremely long period of time is needed to complete the coating operation according to the conventional method. To the contrary, the instant method according to the illustrated embodiment of the invention permits the formation of the resin layer 12** in a drastically reduced length of time, with a simplified procedure.

Unlike the conventional method wherein the resin layer partly formed on the workpiece is melted from its outer surface during the repeated heatings in a furnace, the illustrated method of the invention permits the powdered mass 42 surrounding the workpiece 11 to be melted from the innermost portion contacting the outer surface 26 of the workpiece 11. Therefore, the molten resin layer 12*a* is less likely to have voids which are left in the resin layer 12, whereby the resin layer 12 is characterized by increased adherence to the outer surface 26 of the workpiece 11. Further, the thickness of the resin layer 12 can be easily controlled, or varied from one workpiece to another, since the induction heating permits easy control of the temperature of the workpiece 11.

Figure 6:
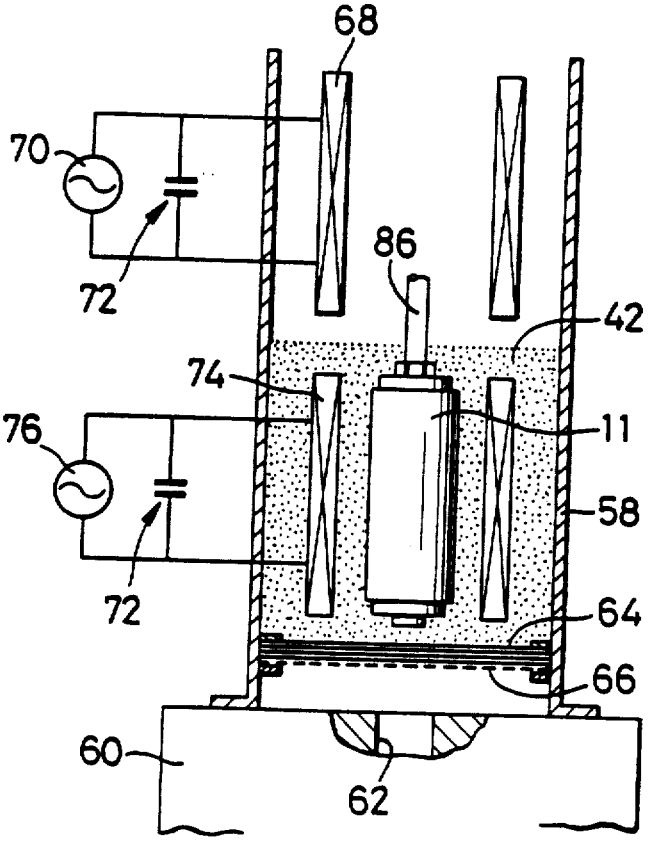
FIG. 6 is an elevational view showing a step of applying the synthetic resin layer according to the modified embodiment of FIG. 5.
Figure 5:
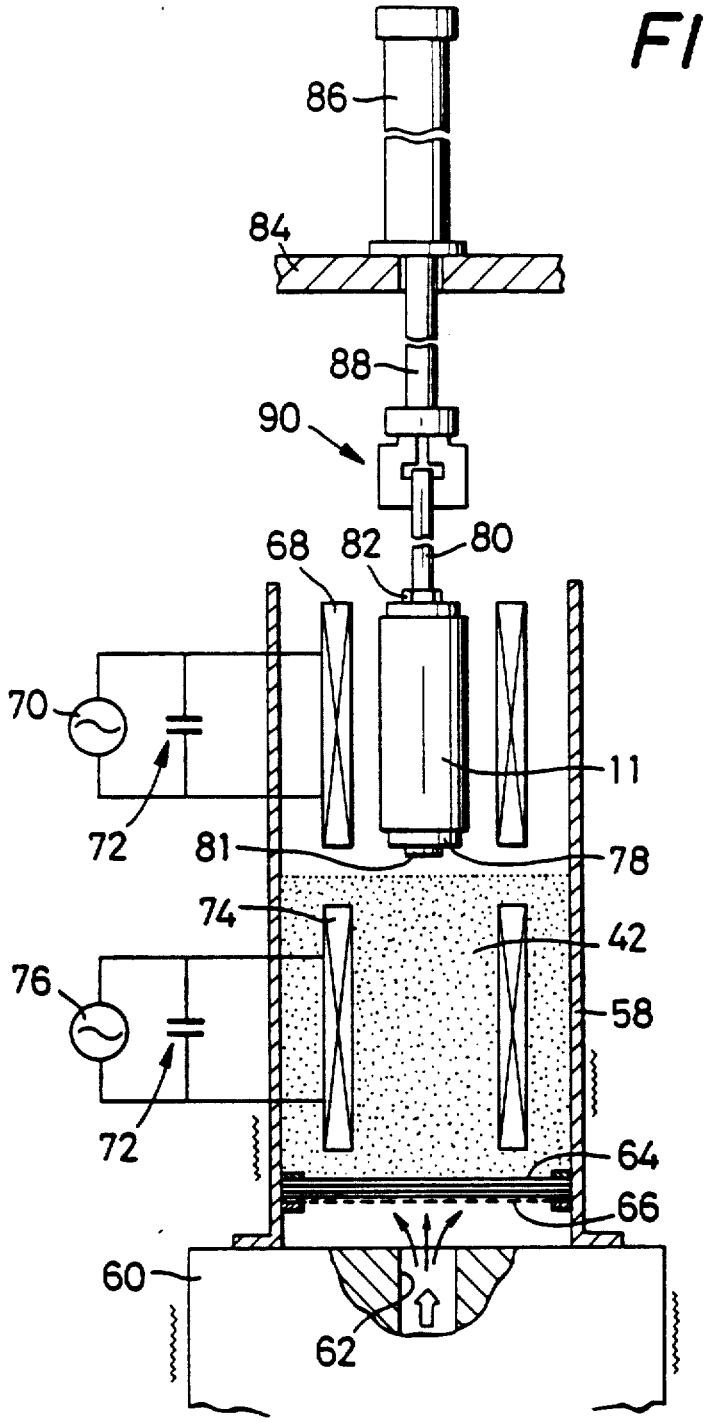
FIG. 5 is an elevational view in cross section of a modified embodiment of the apparatus of the invention, and heating steps of one method of the invention practiced by the modified apparatus.

Another embodiment of the present invention is illustrated in FIGS. 5 and 6, wherein reference numeral 58 designates a container in which the powdered mass 42 is accommodated. In this modified embodiment, the workpiece 11 is subjected to a preliminary heating step (which will be described), before it is immersed into the powdered mass 42 maintained in a fluid state. To improve the fluidity of the powdered mass 42, the container 42 mounted on an oscillating device 60 is oscillated while compressed air is blown into the powdered mass 42, through a passage 62 formed in the oscillating device 60, and the bottom of the container 58. The oscillatory movements of the container 58 and the powdered mass 42 act to reduce friction of the resin particles of the powdered mass 42 which are supported or levitated by the upward flows of the compressed air through the powdered mass 42. Thus, the oscillation of the powdered mass 42 is combined with the upward flows of the compressed air to enhance the fluidity of the powdered mass 42.

Various known oscillators such as a mechanical oscillator using an unbalancing weight may be used as the oscillating device 60. Preferably, the oscillating device 60 is operated at an oscillating frequency within an approximate range of 1500–2000 Hz, and at an acceleration within an approximate range of 2.5–3.0 G. The container 58 has a gas-permeable bottom in the form of an air filter 64 for uniform distribution of the air from the passage 62 into the powdered mass 42. The air filter 64 must have a texture which is fine enough to avoid a channeling phenomenon in which wide fluid paths are formed in the portions of the powdered mass 42 at which the flow resistance is comparatively low. In the present embodiment, the air filter 64 consists of a plurality of semi-transparent parchment paper sheets superposed on each other (for example, 15 sheets). The parchment paper is usually used as tracing paper in drafting of drawings. The air filter 64 is supported by a net 66 at the bottom of the container 58. While the air filter 64 is used to form the gas-permeable bottom of the container 58, it is possible to replace the air filter 64 by other gas-permeable members such as a porous plate made of polyethylene or ceramics, or a metallic filter, which permits permeation of a gaseous fluid therethrough, but not of the resin particles. Where a metallic filter is used, it must be located more than 200 mm away from a lower induction heating coil 74 (which will be described).

In an upper half of the container 58 which is not filled with the powdered mass 42, an upper induction heating coil 68 for preliminary heating of the workpiece 11 is fixedly disposed. This heating coil 68, which is similar to a coil used for induction hardening, is positioned so as to surround the workpiece 11 when placed in its preliminary heating position of FIG. 5, such that the heating coil 68 is spaced a suitable distance away from the periphery of the workpiece 11. With the upper coil 68 energized by a power supply 70, the workpiece 11 is induction-heated in the same manner as described in connection with the heating coil 36 of the preceding embodiment. For an improved power factor of the power supply circuit, a capacitor 72 is provided between the power supply 70 and the coil 68, in parallel connection with the power supply 70. The upper induction heating coil 68 has a coolant passage formed therein to circulate a coolant. The coil 68 is mounted on a bracket (not shown) which is supported by a suitable suspension member fixed to a member outside the container 58. While the upper coil 68 may be circular in cross section taken perpendicularly to the plane of FIG. 5, it is preferred that the coil 68 has an elliptical cross sectional shape with a contant distance away from the external profile of the workpiece 11, over the entire periphery of the latter or except the opposite concave portions of the periphery adjacent to the central axial bore 22.

The previously indicated lower induction heating coil 74 is fixedly disposed within the powdered mass 42, so that the workpiece 11 immersed in the powdered mass 42 is surrounded by the coil 74 and induction-heated when the coil 74 is energized by a power supply 76. Like the upper coil 68, this lower coil 74 is supported by a suitable suspension member such as wires or a bracket. Although the upper and lower coils 68, 74 may be fixed to the container 58 by means of brackets or faceplates, it is desired that the coils 68, 74 be supported by a member other than the container 58, since the container 58 is oscillated by the oscillating device 60.

As in the preceding embodiment, closure members 78, 78 are used to close the open ends of the axial bores 24, 24 formed in the workpiece 11. In the present embodiment, however, a support rod 80 is inserted through the central axial bore 22 in the workpiece 11, such that the head 81 of the rod 80 is in abutment on the lower closure member 78. The closure member 78, 78 and the rod 80 are fixed to the workpiece 11 by tightening a nut 82 which engages an externally threaded portion of the rod 80. The closure members 78, 78 are preferably formed of asbestos mixed with a cement, made of ceramics and coated with a suitable resin such as tetrafluoroethylene, or made of brass, stainless steel or other metallic materials which are difficult to be induction-heated, or formed of a heat resistant resin which is not deformed by heat from the heated workpiece 11. Similar metallic or resin materials are used for the support rod 80 and the nut 52. At any rate, the materials for the closure and support members 78, 80, 82 are selected so as to protect these members from deposition of the synthetic resin of the powdered mass 42.

Above the container 11, there is provided a stationary member 84 on which a cylinder 86 is mounted such that its piston rod 88 extends downward toward the container 58. The piston rod 88 carries at its end suitable means for holding the upper end of the support rod 80. For example, the piston rod 88 is equipped with a chuck 90 as illustrated in FIG. 5, or provided at its end with a tapered bore which fits the tapered upper end of the rod 80. In the latter case, a pin or screw is used to maintain the engagement of the tapered end of the rod 80 with the tapered bore of the piston rod 88.

The operation of the apparatus of FIG. 5 constructed as described above will now be described, referring further to FIG. 6.

The workpiece 11 whose outer surface 26 is pretreated as previously described is supported together with the enclosure members 78, 78, with the support rod 80 connected to the piston rod 88. The cylinder 86 is first activated to hold the workpiece 11 in its preliminary heating position of FIG. 5, at which the workpiece 11 is surround by the upper induction heating coil 68. In this condition, the upper coil 68 is energized to induction-heat the workpiece 11 to a temperature above the melting point of the synthetic resin of the powdered mass 42. In the case where a copolymer of tetrafluoroethylene and ethylene (AFLON) is used, the workpiece 11 is heated to a temperature higher than the melting point of 260° C. of the AFLON. For better quality of the resin layer 12 to be formed, and for higher coating efficiency, it is advisable that the heating temperature of the workpiece 11 is held at a level below the thermal decomposition point of 360° C., preferably within a range of 300°–340° C., and more preferably in the neighborhood of 340° C. However, the workpiece 11 may be heated to a point just below 360°, as the workpiece 11 is cooled while the workpiece 11 is immersed into the powdered mass 42 in the subsequent step. The preliminary heating of the workpiece 11 by the upper coil 68 is accomplished, for example, by applying an electric current of about 3 KHz to the coil 68 for about 120–150 seconds. In this case, the workpiece 11 may be heated substantially uniformly at its outer portion, and at its inner portion to some extent.

The workpiece 11 subjected to the preliminary heating by the upper coil 68 is then lowered, by a further downward movement of the piston rod 88, so that the workpiece 11 is embedded within the powdered mass 42. This movement of the workpiece 11 into the powdered mass 42 is facilitated by an oscillatory movement of the powdered mass 42 via the container 58, and upward air flows into the powdered mass 42 through the air filter 64. Namely, the workpiece 11 is easily immersed into the powdered mass kept in a fluid state. During the immersion of the workpiece 11 into the powdered mass 42, the power supply 76 for the lower coil 74 is held off.

While the workpiece 11 is being immersed into the powdered mass 42, the outer surface 26 of the workpiece 11 heated above the melting point of the powdered mass 42 contacts the powdered mass 42 with a relative movement therebetween. Consequently, the synthetic resin contacting the outer surface 26 is instantaneously melted and deposited on the surface 26 as a thin molten resin layer, without voids left in the molten resin layer. Even if voids are produced in the molten portion of the powdered mass 42 adjacent to the outer surface 26, such voids are moved along the surface 26, due to the relative movement of the workpiece 11 relative to the powdered mass 42, whereby the voids do not prevent the molten synthetic resin from adhering to specific parts of the outer surface 26.

In about 20–30 seconds after the start of movement of the workpiece 11 toward the powdered mass 42, the workpiece 11 has been completely immersed in the powdered mass 42, that is, moved to the position of FIG. 6 at which the workpiece 11 is surrounded by the lower induction heating coil 74. At this time, the oscillating device 60 is turned off, and the air supply from the passage 62 is stopped. The melting of the synthetic resin adjacent to the workpiece 11 continues in the position of FIG. 6. If the powdered mass 42 is still kept in a fluid state, air channels tend to be formed at the interface of the outer surface 26 and the powdered mass 42, which channels prevent deposition of the molten resin onto the corresponding parts of the surface 26. For this reason, the air blast into the powdered mass 42 and the oscillation of the container 58 are discontinued when the workpiece 11 has been completely immersed in the powdered mass 42.

Figure 7:
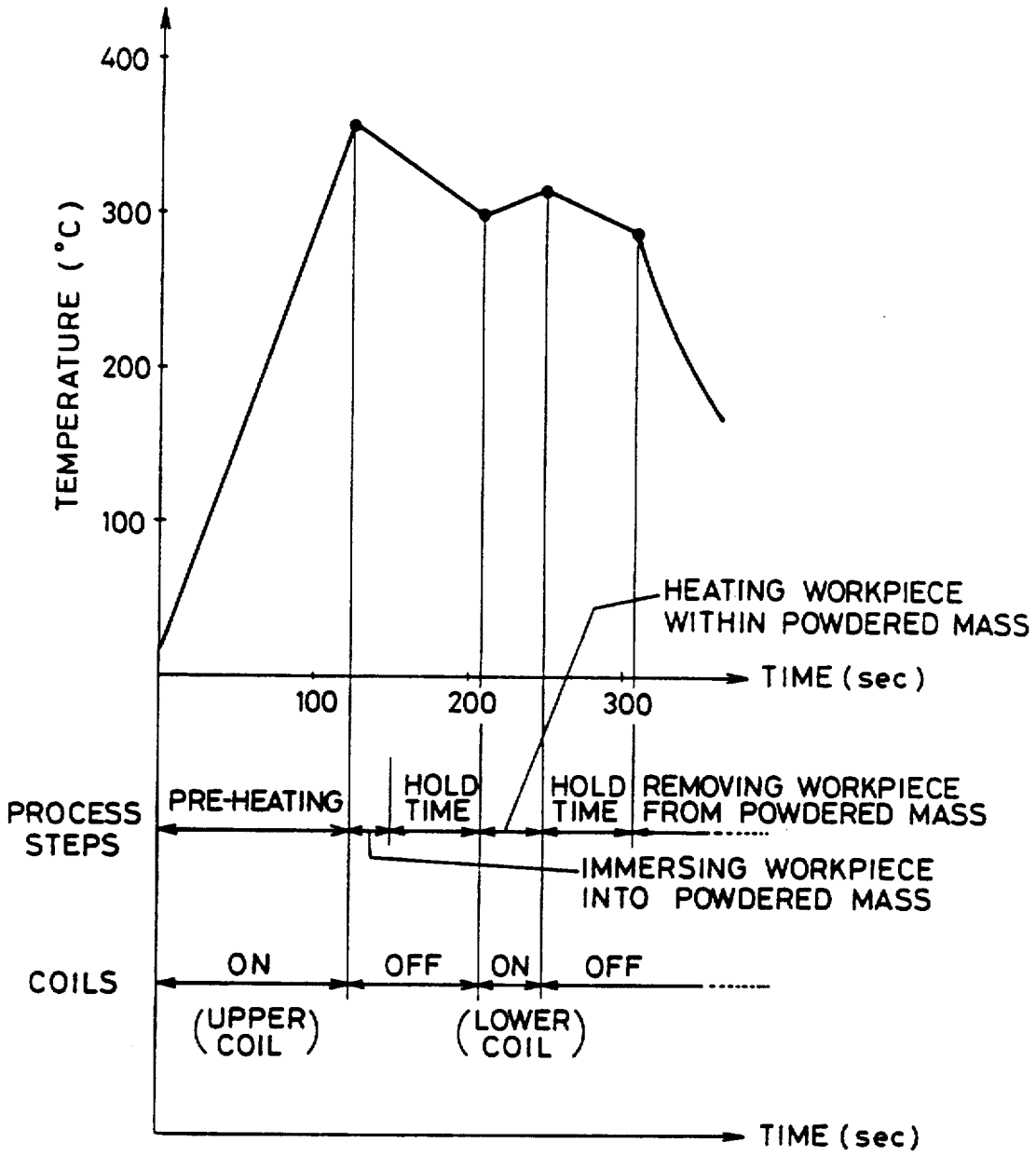
FIG. 7 is a graph showing steps of the method of FIG. 5, in relation with the temperature of the core member of the rotor varying with the time.

After the workpiece 11 has been fully immersed in the powdered mass 42 and the powdered mass 42 has been brought to a non-fluid state, the workpiece 11 is left in the powdered mass 42 for a suitable time, for example, 60 seconds, without energization of the lower coil 74. In this holding time period, an additional amount of the synthetic resin is melted and deposited on the surface 26 of the workpiece 11, whereby the thickness of the molten resin layer adhering to the surface 26 of the workpiece 11 is gradually increased. As the deposition of the synthetic resin to the surface 26, the temperature of the workpiece 11 is gradually lowered, as indicated in FIG. 7. To keep the workpiece 11 at a temperature within a predetermined range, the workpiece 11 is re-heated with the power supply 76 turned on, when the workpiece 11 has been cooled below 300° C., for example. Namely, an induction current of about 3 KHz frequency for example is applied to the lower induction heating coil 74 for a suitable period of time (40 seconds, for example) to re-heat the workpiece 11 up to 320° C., for example, as also indicted in FIG. 7.

Then, the workpiece 11 is left in the powdered mass 42 for 60 seconds, for example, with the lower coil 74 kept deenergized. With the re-heating of the workpiece 11 and the subsequent hold time, the molten resin layer adhering to the outer surface 26 of the workpiece 11 further develops. In this specific example, the sum of the first hold time prior to the re-heating, the re-heating time, and the second hold time subsequent to the re-heating, amounts to about 2–3 minutes. During this time period, the resin layer 12 to be formed is given a thickness of about 1.2 mm. The re-heating time and the hold times are selected so as to obtain a desired thickness of the resin layer 12. The second hold time following the re-heating time is provided for maximum utilization of the thermal energy given to the workpiece 11, for deposition of the synthetic resin on the workpiece 11. If a reduction in the cycle time is preferred to an increase in the thermal efficiency, the workpiece 11 may be taken out of the powdered mass 42 immediately after the termination of the re-heating step.

The workpiece 11 coated with the resin layer of a desired thickness is then removed out of the powdered mass 42 with the upward movement of the piston rod 88 of the cylinder 86 (FIG. 5). This removal of the workpiece 11 is accomplished while the powdered mass 42 is kept in a fluid state, as in the step of immersing the workpiece 11 into the powdered mass 42. That is, the oscillating device 60 is turned on and the compressed air is supplied through the passage 62, before the cylinder 86 is activated to raise the workpiece 11. In this way, the workpiece 11 is easily removed from the powdered mass 42.

Figure 8:
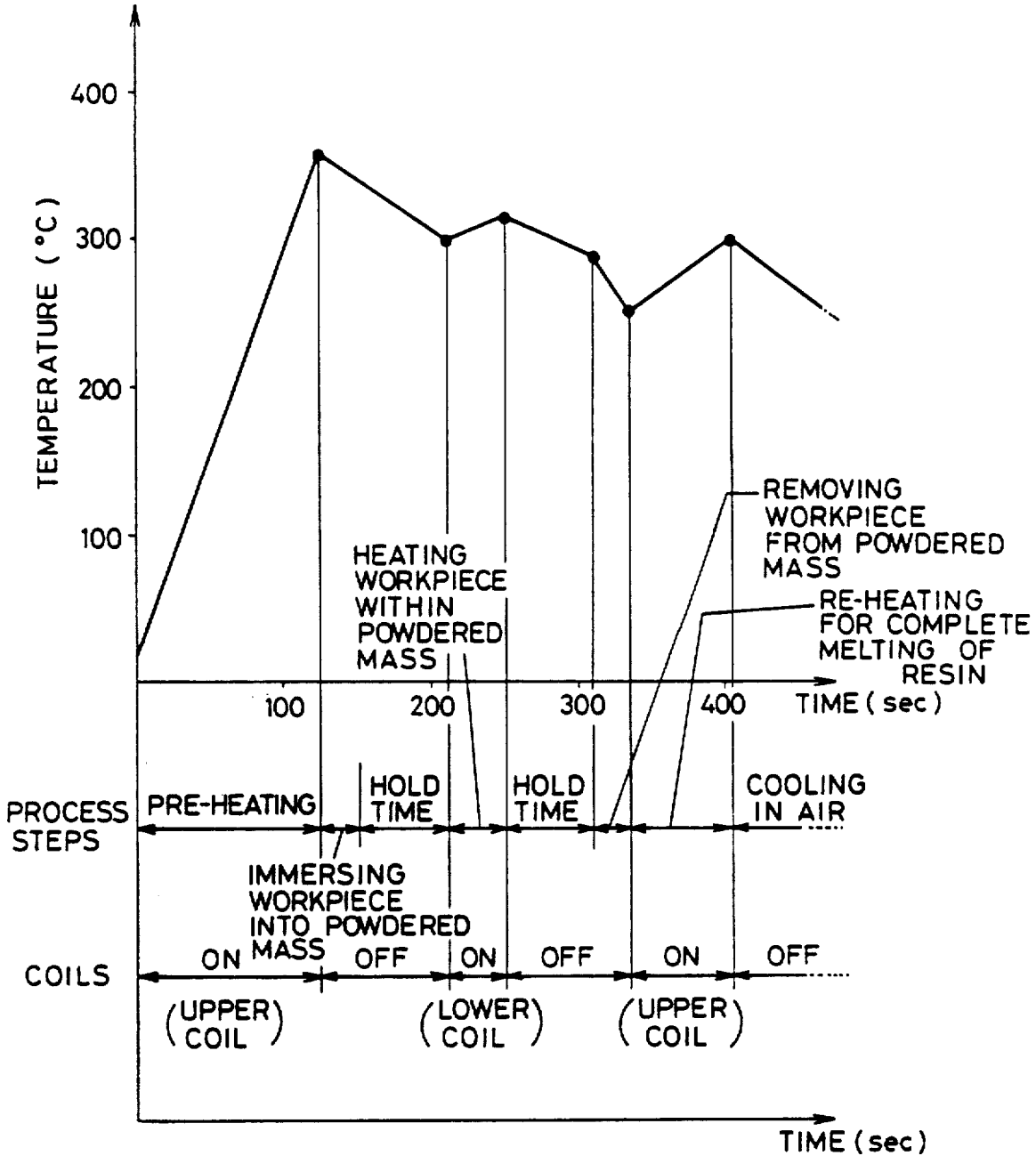
FIG. 8 is a view corresponding to FIG. 7, illustrating a further modified embodiment of the method of the invention.

Another modified embodiment of the invention is illustrated in FIG. 8. This embodiment is different from the preceding embodiment of FIG. 7, in that the workpiece 11 is re-heated again after the workpiece 11 has been removed out of the powdered mass 42.

The second re-heating of the workpiece 11 after the removal thereof from the powdered mass 42 is effective for improved yield of the synthetic resin material, that is, for minimum waste of the material. Described more specifically, the resin layer deposited on the outer surface 26 of the workpiece 11 taken out of the powdered mass 42 carries at its surface incompletely or partially melted or fused particles of the resin. To completely melt these incompletely melted resin particles, the workpiece 11 is located within the upper induction heating coil 68, and is re-heated up to about 300° C., with an induction current applied to the coil 68 for about 40 seconds, for example, as indicated in FIG. 8, whereby the partially melted outer portion of the resin layer adhering to the surface 26 of the workpiece 11 is completely or fully melted so as to form a perfectly integral part of the resin layer. In other words, the resin layer to be obtained consists of the fully melted particles of the synthetic resin material, over the entire thickness from the interface between the resin layer and the outer surface 26 of the workpiece 11, to the very surface of the resin layer. Accordingly, the synthetic resin material is effectively used, with minimum waste due to removal of the outer portion of the resin layer during a subsequent step of finishing the resin layer to desired final shape and thickness.

After the final re-heating of the workpiece 11 for complete melting of the resin layer adhering to the outer surface 26, the workpiece 11 is cooled and solidified in air. The thus obtained resin layer 12 has a high level of adherence to the outer surface 26 of the workpiece 11, since the coating method described above is adapted to minimize the existence of voids left between the outer surface 26 of the workpiece 11 and the resin layer 12 formed thereon.

While the workpiece 11 is re-heated after the first holding time period following the immersion of the workpiece 11 into the powdered mass 42, it is possible that the power supply 76 is turned on to re-heat the workpiece 11 by the lower coil 74, when the immersion of the workpiece 11 is started, or immediately after the completion of the immersion. Further, only the air blast into the powdered mass 42, or only the oscillation of the container 58 by the oscillating device 60, may be used to keep the powdered mass 42 in a fluid state. However, it is preferable to use both of the air blast and the oscillation, in view of the inconveniences that are encoutered if only one of the above two means is utilized for improving the fluidity of the powdered mass 42. Described in more detail, the inner portion of the powdered mass 42 is difficult to be sufficiently oscillated by the oscillating device 60 without the air blast into the powdered mass 42. On the other hand, the air blast tends to cause air channeling paths in the portions of the powdered mass 42 having a relatively low resistance to the air flow, if the powdered mass 42 is not oscillated.

Although the apparatus illustrated in FIGS. 5 and 6 uses two induction heating coil in the form of the upper and lower coils 68, 74, the apparatus may be provided with a single coil which is adapted to be movable between an upper position for effecting the preliminary heating and the second re-heating, and a lower position for effecting the first re-heating of the workpiece within the powdered mass. In this case, the single coil serves as the upper and lower coils 68, 74.

While the illustrated embodiments are adapted to move the workpiece 11 into the powdered mass 42 contained in the stationary container 30 or 58, it is possible that the container is adapted to be movable relative to the workpiece 11 held at a fixed position.

Another alternative method for placing the workpiece 11 within the powdered mass 42 comprises the steps of positioning the workpiece 11 in an empty container, and filling the container with a powdered mass so as to surround the workpiece 11. In this instance, it is not necessary to keep the powdered mass in a fluid state to embed the workpiece 11 within the powdered mass.

In the illustrated embodiments of FIGS. 5–8, the workpiece 11 (metallic core member of the rotor 4) is made of an aluminum alloy as previously described. However, the method and apparatus of the invention is applicable to a workpiece made of other materials such as steels.

While induction heating of the workpiece 11 within the powdered mass 42 is essential, the heating of the workpiece 11 outside the powdered mass 42 may be made by other heating means or methods utilizing the principle of radiation, convection or conduction of heat, for example, by an electric heater, or a furnace utilizing combustion heat.

The present invention is effective particularly when a synthetic resin used as a coating material is a fluorethylene resin (such as a copolymer of tetrafluoroethylene and ethylene) which has a comparatively small difference between its melting and thermal decomposition points. However, the principle of the present invention may be practiced not only with other thermoplastic resin materials such as nylon and polyethylene, but also with thermosetting resins.

Although the workpiece 11 handled in the illustrated embodiments is a metallic core member of a lobe-type rotor of a rotary pump of a Roots type, the method and apparatus of the invention may be adapted to handle other types of metallic rotors for Roots-type or other rotary fluid machines, or other kinds of metallic workpieces.

While the present invention has been described in its preferred embodiments with a certain degree of particularity, it is to be understood that the invention is by no means confined to the precise details of the illustrated embodiments, but may be embodied with various other changes, modifications and improvements which may occur to those skilled in the art, without departing from the spirit and scope of the invention defined in the appended claims.

What is claimed is:

1. A method of applying a synthetic resin layer to an outer surface of a metal part, comprising the steps of:

effecting a preliminary heating of said metal part to a temperature between a melting point and a thermal decomposition point of a thermally fusible synthetic resin;

placing said metal part subjected to said preliminary heating, within a powdered mass of said thermally fusible synthetic resin;

induction-heating said metal part within said powdered mass to a temperature between said melting point and said thermal decomposition point of said synthetic resin, thereby melting a portion of said powdered mass surrounding said outer surface of the heated metal part, and depositing the molten portion of said powdered mass on said outer surface of said heated metal part, as said synthetic resin layer having a predetermined thickness; and removing said metal part, coated with said synthetic resin layer, from said powdered mass.

2. A method according to claim 1, further comprising blowing air into said powdered mass through a bottom of a container accomodating said powdered mass, thereby maintaining said powdered mass in a fluid state, wherein placing said metal part in a powdered mass further comprises immersing said metal part into said powdered mass maintained in said fluid state.

3. A method according to claim 2, wherein said step of blowing air further comprises continuously blowing air while induction heating said metal part.

4. A method according to claim 2, which further comprises discontinuing blowing air before induction heating said metal part.

5. A method according to claim 2, which further comprises oscillating said container while immersing said metal part into said powdered mass in said fluid state.

6. A method according to claim 1, which further comprises accommodating said powdered mass in a container made of a dielectric material, wherein said induction heating of said metal part further comprises applying a current to an induction heating coil disposed around said container.

7. A method according to claim 1, wherein said effecting of preliminary heating comprises induction heating.

8. A method according to claim 1, which further comprises supplemental heating of said metal part to a temperature higher than the melting point of said synthetic resin after removing said metal part coated with said resin layer out of said powdered mass, thereby completely melting incompletely melted particles of said synthetic resin which are deposited on said outer surface of said metal part.

9. A method according to claim 8, wherein said supplemental heating comprises induction heating.

10. A method according to claim 1, wherein said metal part comprises a core member of a rotor for a rotary fluid machine of a Roots type, and said synthetic resin comprises a copolymer of tetrafluoroethylene and ethylene.

11. A method according to claim 1, wherein said preliminary heating is effected for a time period of about 120–150 seconds.

12. A method according to claim 1, further comprising holding said metal part within said powdered mass, for a first hold time between the placement of said metal part within said powdered mass and said induction-heating of said metal part, and holding said metal part within said powdered mass, for a second hold time between the termination of said induction-heating of said metal part and the removal of said metal part from said powdered mass.

13. A method according to claim 12, wherein a sum of said first and second hold time, and a time of said induction-heating of said metal part is within a range of about 2–3 minutes.

* * * * *

UNITED STATES PATENT AND TRADEMARK OFFICE

CERTIFICATE OF CORRECTION

PATENT NO. : 4,806,388

DATED : February 21, 1989

INVENTOR(S) : Mochizuki et al.

It is certified that error appears in the above-identified patent and that said Letters Patent is hereby corrected as shown below:

The title page should be deleted to appear as per attached title page.

Figures 1-8 should be inserted as part of the Letters Patent as shown on the attached sheets.

Signed and Sealed this

Third Day of September, 1991

*Attest:*

HARRY F. MANBECK, JR.

*Attesting Officer*

*Commissioner of Patents and Trademarks*

United States Patent [19]

Mochizuki et al.

[11] Patent Number: 4,806,388

[45] Date of Patent: Feb. 21, 1989

[54] METHOD AND APPARATUS FOR COATING METAL PART WITH SYNTHETIC RESIN

[75] Inventors: Hiroyuki Mochizuki, Aichi; Nobuo Kobayashi; Shigenori Tamaki, both of Toyota; Takahiro Iwase, Anjyo; Naofumi Masuda; Yoshio Taguchi, both of Nagoya, all of Japan

[73] Assignee: Toyota Jidosha Kabushiki Kaisha, Toyota, Japan

[21] Appl. No.: 886,392

[22] Filed: Jul. 17, 1986

[51] Int. Cl.[4] ..... B05D 3/14

[52] U.S. Cl. ..... 427/46; 427/185; 427/195; 118/429; 118/620; 118/DIG. 5

[58] Field of Search ..... 427/46, 185, 195; 118/DIG. 5, 429, 620

[56] References Cited

U.S. PATENT DOCUMENTS

| | | | |
|---|---|---|---|
| 2,974,059 | 3/1961 | Gemmer | 427/185 |
| 2,974,060 | 3/1961 | Dettling | 427/185 |
| 3,063,860 | 11/1962 | Gemmer | 427/195 X |
| 3,090,696 | 5/1963 | Gemmer | 427/185 |
| 3,097,958 | 7/1963 | Morris | 118/DIG. 5 |
| 3,161,483 | 12/1964 | Morris | 34/57 |
| 3,183,113 | 5/1965 | Gemmer | 427/185 |
| 3,197,328 | 7/1965 | Jung et al. | 118/DIG. 5 |
| 3,227,636 | 1/1966 | De Hart | 427/185 X |
| 3,250,643 | 5/1966 | Sergent | 118/DIG. 5 |
| 3,261,707 | 7/1966 | Korski et al. | 118/DIG. 5 |
| 3,282,249 | 11/1966 | Ramsay | 118/DIG. 5 |
| 3,383,233 | 5/1968 | Curcio | 427/185 X |
| 3,419,409 | 12/1968 | Dettling | 427/185 |
| 3,431,887 | 3/1969 | Pettigrew et al. | 118/DIG. 5 |
| 3,514,308 | 5/1970 | Scott et al. | 427/185 |
| 3,925,570 | 12/1975 | Reinke et al. | 427/46 |
| 3,959,525 | 5/1976 | Sentementes et al. | 427/185 |
| 3,985,097 | 10/1976 | Sitton | 427/185 X |
| 4,466,989 | 8/1984 | Haller et al. | 427/185 |
| 4,693,813 | 9/1987 | Takeshita et al. | 409/244 |

FOREIGN PATENT DOCUMENTS

| | | | |
|---|---|---|---|
| 682664 | 3/1964 | Canada | 427/185 |
| 238185 | 11/1985 | Japan . | |

OTHER PUBLICATIONS

B. Wiedemann, SAE Technical Paper Series (Development of Volkswagen's Supercharger G-Lader), Feb. 24–28, 1986.

Stott, Louis L., "Fluidized Bed Method of Coating", *Organic Finishing* (Jun. 1956) pp. 16–17.

"Powder Coating", *Products Finishing* (Oct. 1970) pp. 70–77.

PTO. English Translation of 60-238185, Dec. 1987.

*Primary Examiner*—Shrive Beck
*Assistant Examiner*—Alain Bashore
*Attorney, Agent, or Firm*—Oblon, Fisher, Spivak, McClelland & Maier

[57] ABSTRACT

A method and apparatus for applying a synthetic resin layer to an outer surface of a metal part while the metal part is placed within a powdered mass of a thermally fusible synthetic resin. The metal part within the powdered mass is induction-heated to a temperature higher than a melting point and lower than a thermal decomposition point of the synthetic resin, in order to melt a portion of the powdered mass surrounding the heated metal part, and thereby permit the molten portion of the powdered mass to be deposited as the synthetic resin layer on the outer surface of the heated metal part. To facilitate the placement of the metal part in the powdered mass, air may be blown into the powdered mass to keep the mass in a fluid state.

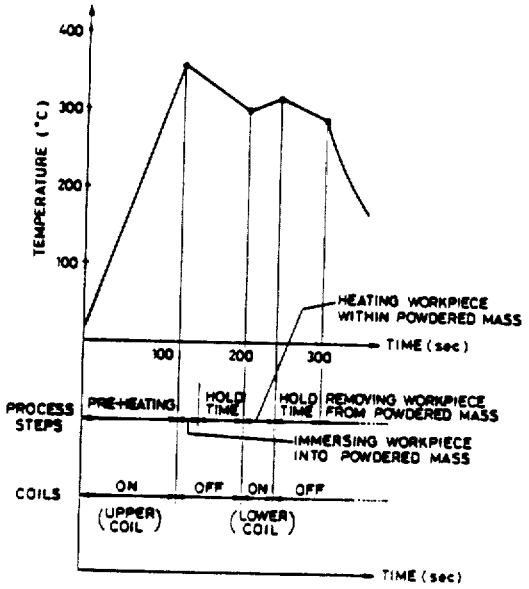

13 Claims, 8 Drawing Sheets